United States Patent [19]

Maenaka et al.

[11] Patent Number: 4,746,848

[45] Date of Patent: May 24, 1988

[54] WEFT YARN FEEDING DEVICE FOR A LOOM

[75] Inventors: Kosuke Maenaka; Kensuke Wakamatsu, both of Matsuto; Yoshitsugu Tamura; Yoshitaka Fujita, both of Kanazawa, all of Japan

[73] Assignee: Tsudakoma Corp., Ishikawa, Japan

[21] Appl. No.: 931,481

[22] Filed: Nov. 14, 1986

[30] Foreign Application Priority Data

| | | | |
|---|---|---|---|
| Dec. 13, 1985 | [JP] | Japan | 60-191979[U] |
| Apr. 11, 1986 | [JP] | Japan | 61-53536[U] |
| May 2, 1986 | [JP] | Japan | 61-103676 |
| Jun. 9, 1986 | [JP] | Japan | 61-88340[U] |

[51] Int. Cl.[4] ..... G05B 19/29

[52] U.S. Cl. ..... 318/603; 318/594; 318/39; 139/452

[58] Field of Search ..... 139/452; 318/561, 565, 318/599, 600, 626, 637, 652, 603, 595, 590, 594, 39, 41, 49, 55

[56] References Cited

U.S. PATENT DOCUMENTS

| | | | |
|---|---|---|---|
| 4,297,624 | 10/1981 | Komiya | 318/594 |
| 4,347,470 | 8/1982 | Kohzai et al. | 318/603 |
| 4,359,676 | 11/1982 | Fujioka | 318/653 |
| 4,529,017 | 7/1985 | Suzuki et al. . | |
| 4,529,922 | 7/1985 | Ono | 318/661 |
| 4,530,381 | 7/1985 | Takegawa . | |
| 4,541,462 | 9/1985 | Tholander . | |
| 4,586,543 | 5/1986 | Volland et al. . | |

FOREIGN PATENT DOCUMENTS

| | | |
|---|---|---|
| 58-31145 | 2/1983 | Japan . |
| 59-204947 | 11/1984 | Japan . |
| 60-28551 | 2/1985 | Japan . |

*Primary Examiner*—William M. Shoop, Jr.
*Assistant Examiner*—David Martin
*Attorney, Agent, or Firm*—Wenderoth, Lind & Ponack

[57] ABSTRACT

A weft yarn feed device (1) comprises a measuring and storing drum (7) for storing a predetermined length of a weft yarn (4) thereon for picking operation, a rotary yarn guide (6) for winding the weft yarn (4) on the measuring and storing drum (7), a feed motor (8) for rotating the rotary yarn guide (6), a drive control unit (3) for controlling the operation of the feed motor (8), and a command control unit (2) which gives commands to the drive control unit (3). The length of the weft yarn (4) wound on the measuring and storing drum (7) is detected accurately on the basis of the relation between the number of rotation of the rotary yarn guide (6) and that of the crankshaft of the loom, and a detection signal indicating the length of the weft yarn (4) wound on the measuring and storing drum (7) is fed back to the command control unit (2) to control the feed motor (8) properly for winding a predetermined length of the weft yarn (4) on the measuring and storing drum. The drive control unit (3) comprises a reference setting device (23) which provides a voltage corresponding to a reference rotating speed of the feed motor (8) so that the feed motor (8) is driven continuously for rotation at a slightly varying rotating speed about the reference rotating speed, and preparatory winding controller (26) for controlling the feed motor (8) for winding the predetermined length of the weft yarn (4) on the measuring and storing drum (7) while the loom is stopped.

18 Claims, 12 Drawing Sheets

WEFT YARN FEEDING DEVICE FOR A LOOM

BACKGROUND OF THE INVENTION

1. Field of the the Invention

The present invention relates to a drum-type weft yarn feeding device and, more specifically, to a technique for controlling the rotary motion of the rotary yarn guide of a drum-type weft yarn feeding device.

In the drum-type weft yarn feeding device of this kind, a length of a weft yarn necessary for one picking cycle or several picking cycles is measured and stored on a stationary measuring and storing drum by pulling out the weft yarn from a supply package and winding the same on the stationary measuring and storing drum, the free end of the weft yarn is restrained on the circumference of the drum with a restraining pin. The restraining pin is retracted to release the weft yarn for picking operation. Upon the release of the weft yarn, a picking nozzle jets a pressurized fluid into the shed of warp yarns to pick the weft yarn previously stored on the drum.

Ordinarily, the rotary yarn guide and the restraining pin are interlocked mechanically with the crankshaft of the loom in order to control the rotary yarn guide and the restraining pin in synchronism with the main weaving motion of the loom. However, on a high-speed loom, the rotary yarn guide and the restraining pin mechanically interlocked with the crankshaft are unable to follow the main weaving motion of the loom. Furthermore, the free selection of weft yarns for weaving operation multiple weft yarns is difficult. Such problems can be solved by driving the rotary yarn guide by an individual feed motor instead of the crankshaft through mechanical means. When such an individual feed motor is employed, the weft yarn feeding mechanism needs to control the feed motor.

2. Description of the Prior Art

Japanese Patent Laid-open Publication No. 59-204,947 discloses an invention in which the length of the weft yarn wound on a measuring and storing drum is detected optically to control the feed motor on the basis of the result of detection.

Incidentally, adverse effects affecting picking operation, such as resistance against pulling out the weft yarn from the measuing and storing drum, can be diminished by reducing the length of the weft yarn wound on the measuring and storing drum to improve picking conditions. However, the reduction of the length of the weft yarn stored on the measuring and storing drum required frequent on-off operation of the feed motor, which affects adversely to the feed motor resulting in unstable winding of the weft yarn on the measuring and storing drum.

On the other hand, the frequency of the on-off operation of the feed motor can be reduced by increasing the length of the weft yarn wound on the measuring and storing drum in one winding cycle. However, when a length of the weft yarn for a plurality of picking cycles is stored on the measuring and storing drum, a complicated separating mechanism for separating the loops of the weft yarns is necessary for preventing the entanglement of the weft yarn on the measuring and storing drum. Such a separating mechanism makes the constitution of the weft yarn feeding mechanism complicated and increases the load on the feed motor, and hence the weft yarn feeding mechanism requires a large feed motor.

Furthermore, the reliability of the optical sensor for detecting the length of the weft yarn wound on the measuring and storing drum is dependent on the type of the weft yarn. A mechanical sensor employing a detecting lever for detecting the length of the weft yarn wound on the measuring and storing drum increases the tension of the weft yarn being picked adversely affecting the stability of picking operation.

Japanese Patent laid-open Publication No. 58-31,145 discloses an invention in which a pulse motor is employed as the feed motor. The rotation of the pulse motor is regulated through an open-loop control mode by giving pulses corresponding to the necessary length of the weft yarn to the pulse motor. However, since the response speed of the pulse motor is not high enough for use on a high-speed loom such as a fluid jet loom. When pulses are given to the pulse motor at a rate exceeding the response speed of the pulse motor, the step-out of the pulse motor occurs and the pulse motor is liable to malfunction.

SUMMARY OF THE INVENTION

Accordingly, it is a first object of the present invention to measure the length of the weft yarn stored on the measuring and storing drum accurately on the basis of the relation between the number of rotation of the rotary yarn guide and the number of rotation of the crankshaft of the loom.

It is a second object of the present invention to measure the length of the weft yarn wound on the measuring and storing drum accurately to additionally control the number of rotation of the output shaft of the feed motor on the basis of the measurement, and to increase the response speed of the feed motor as high as possible.

It is a third object of the present invention to enable the simple variation of the mode of rotary motion of the rotary yarn guide by electrical means according to the picking intervals of the weft yarn for weaving operation using multiple kinds of weft yarns.

It is a further object of the present invention to provide electric circuits for a controller for controlling the weft yarn feeding device.

According to the present invention, the number of rotation of the feed motor for one winding cycle is additionally controlled on the basis of the difference between a signal representing the number of rotation of the rotary yarn guide and a signal representing the number of rotation of the crankshaft of the loom, obtained by an arithmetic and storing device.

On the other hand, the number of rotation of the output shaft of the feed motor is fed back through a negative feedback process by a rotation detector, and a F/V converter, or a tachometer generator to the input of a drive controller of the drive control unit. Accordingly, the feed motor is controlled at a high response speed by the feedback control system to drive the rotary yarn guide for appropriate weft yarn storing operation.

The number of rotation of the crankshaft of the loom is detected by a rotation detector of a command control unit. The output signal of the rotation detector is applied, as required, through a divider serving as a signal converter or through a signal converting circuit to the arithmetic and storage device. The divider or the signal converting circuit divides a signal representing the number of rotation of the crankshaft of the loom by a predetermined dividing ratio or converts the same signal into a predetermined signal to make the rotation signal representing one rotation of the crankshaft of the loom for one picking cycle coincide with a rotation signal representing the number of rotation of the rotary yarn guide during one picking cycle. Consequently, the number of rotation of the rotary yarn guide during one picking cycle can simply be varied through electrical operation.

Furthermore, since the length of the weft yarn stored on the drum is detected electrically and digitally on the basis of the relation between the number of rotation of the crankshaft of the loom and the number of rotation of the rotary yarn guide, namely, that of the output shaft of the feed motor for driving the rotary yarn guide, the possibility of malfunction, as compared with the conventional optical sensor, of the electrical detecting means according to the present invention is reduced, and thereby the reliability of the detection is enhanced.

Still further, since the response speed of the feed motor is increased as high as possible through the proportional control operation and the feed back control operation of the drive control unit, the length of the weft yarn to be stored on the drum can be reduced, so that the possibility of entanglement of the weft yarn is reduced, and a separating mechanism for dividing the loops of the weft yarn into groups of loops each for one picking cycle is not necessary.

Basically, the present invention provides the following characteristic effects.

First, since the command control unit detects electrically and digitally the number of rotation of the crankshaft of the loom, and the number of rotation of the output shaft of the feed motor, namely, that of the rotary yarn guide, the length of the weft yarn stored on the drum can accurately be detected, the detecting operation is carried out stably irrespective of the type of the weft yarn, and malfunction of the detector due to the influence of the external light and fly is prevented. Consequently, stable weft yarn measuring and storing operation is achieved, so that the picking operation is stabilized.

Secondly, since the drive control unit comprises a proportional control system and a feedback speed control system, the response speed of the feed motor is increased. Accordingly, only a small quantity of the weft yarn for two or three picking cycles needs to be stored on the drum while the loom is operating at a high operating speed or at the start of the weaving operation of the loom. Therefore, any complicated separating mechanism for separating the loops of the weft yarn stored on the drum is not necessary, and the picking operation is stabilized because the resistance against pulling out the weft yarn from the drum is reduced. Furthermore, since only a small quantity of the weft yarn needs to be stored on the drum, the entanglement of the weft yarn on the drum is prevented. The omission of the separating mechanism enables the weft yarn feeding device to be disposed close to the picking nozzle, so that the resistance against the picking of the weft yarn is diminished, which reduces the load on the picking nozzle. Still further, the present invention has excellent high-speed response characteristics as compared with the conventional weft yarn feeding device employing a pulse motor.

The respective specific effects of the embodiments of the present invention will be described in the description of the preferred embodiments of the present invention, respectively.

DESCRIPTION OF THE PREFERRED EMBODIMENT

Figure 1:
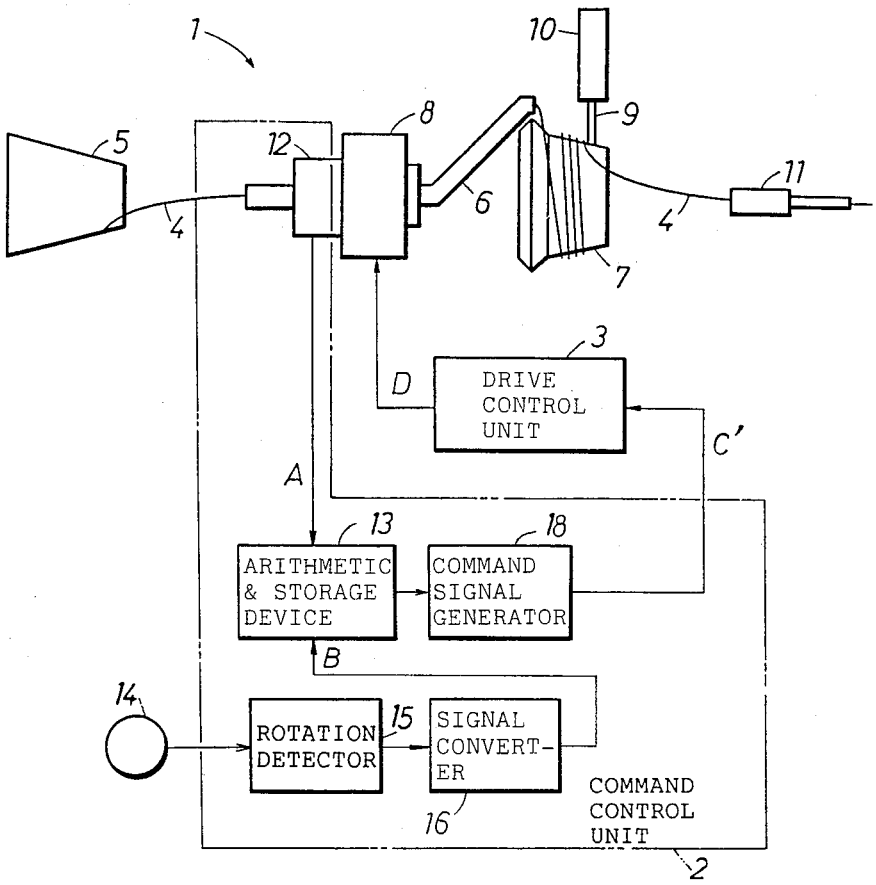
FIGS. 1 and 2 are block diagrams showing the constitution of a weft yarn feeding device according to the present invention.
Figure 2:
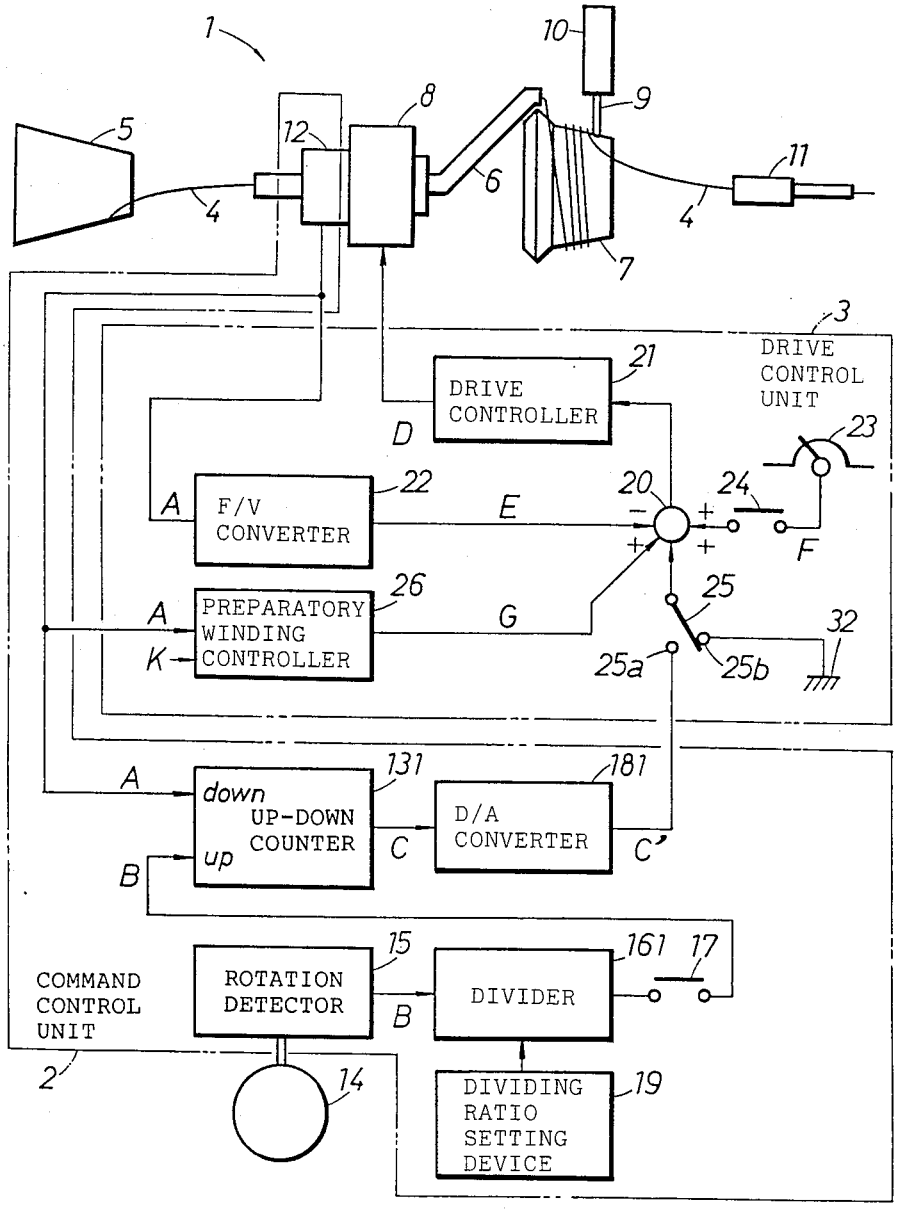

First Embodiment (FIGS. 1 to 3):

FIGS. 1 and 2 illustrate the integral constitution of a weft yarn feeding device 1 according to the present invention, comprising a mechanical unit, a command control unit 2 and a drive control unit 3.

A weft yarn 4 is pulled out from a supply package 5, is passed through a rotary yarn guide 6, and is wound on the circumference of a measuring and storing drum 7 by the rotary yarn guide 6 as the same is rotated. The yarn guide 6 is driven for rotation by a feed motor 8 having an output shaft coupled directly with the stem of the rotary yarn guide 6. During measuring operation, the weft yarn 4 is restrained on the circumference of the drum 7 with a restraining pin 9. The restraining pin 9 is driven toward and away fom the circumference of the drum 7 by, for example, a solenoid 10. The restraining pin 9 is retracted to release the weft yarn 4 stored on the drum 7 for picking. When released, the weft yarn 4 is picked into the shed of warp yarns together with a jet of fluid by a picking nozzle 11. Advance and retractionof the restraining pin 9 and the jet of fluid are carried out in synchronism with the rotation of the loom. The rotation of the rotary yarn guide 6 is detected by a rotation detector 12. The rotation detector applies a digital rotation signal A representing the number of rotation of the rotary yarn guide 6 to the down-input of an up-down counter 131 serving as an arithmetic and storage device 13. On the other hand, the rotation of the crankshaft 14 of the loom is detected by a rotation detector 14, such as a rotary encoder. The rotation detector 15 applies a digital rotation signal B, namely, a pulse signal, representing the number of rotation of the crankshaft 14 through a signal converter 16, such as a divider 161, and an operation contact 17 to the up-input of the up-down counter 131. While the loom is in operation, the operation contact 17 is kept closed by a loom controller.

The up-down counter 131 counts down when the rotation signal A, namely, a pulse signal, is given thereto, and counts up when the rotation signal B, namely, a pulse signal, is given thereto, and then gives a digital command signal C representing the count to a DA converter 181 serving as a comman signal generator 18. The DA converter 181 converts the digital command signal C into a corresponding analog command signal C' and sends the same to the drive control unit 3.

Suppose that four loops of the weft yarn 4 is necessary for one picking cycle and the rotation detector 12 generates a rotation signal A having three pulses for one rotation of the rotary yarn guide 6. Then, twelve pulses are generated while the rotary yarn guide 6 is rotated four turns to wind a length of the weft yarn 4 necessary for one picking cycle. On the other hand, suppose that the rotation detector 15 generates a rotation signal B having sixty pulses while the crankshaft 14 of the loom is rotated one turn and the dividing ratio of the divider 161 is set at five by a dividing ratio setting device 19. Then, a rotation signal B having twelve pulses is applied to the up-input of the up-down counter 131 for one turn of the crankshat 14. The command signal C' is a voltage signal proportional to the count of the up-down counter 131.

The command signal C' is applied through a changeover switch 25 and a summing point 20 of the drive control unit 3 to the input of a drive controller 21 of the drive control unit 3. On the other hand, a reference signal F set by a reference setting device 23 is applied also through a selective contact 24 and the summing point 20 to the input of the drive controller 21. The drive controller is at least capable of proportional action and executes, as occasion demands, an integral control action and derivative action to amplify the command signal C' and the reference signal F to generate a driving signal D for driving the feed motor 8. Since the command signal C' is amplified by the proportional action of the drive controller 21 to provide the driving signal D, the feed motor 8 is driven at a high response speed to rotate the rotary yarn guide 6. At the same time, the rotation detector 12 generates a rotation signal A, which is applied to the down-input of the up-down counter 131. When the count of the up-down counter 131, namely, the command signal C, becomes zero, the voltage of the analog command signal C' becomes zero. Consequently, only the reference signal F is converted into a driving signal D by the drive controller 21 to drive the feed motor 8.

On the contrary, when the count of the up-down counter 131 is a negative value because the down-input signal is greater than the up-input signal, the command signal C'is a negative voltage. Therefore, the drive controller 21 amplifies a voltage obatained by subtracting the absolute value of the command signal C' from the reference signal F for driving the feed motor 8. Thus, four loops of the weft yarn 4 corresponding to a length necessary for one picking cycle is wound and stored accurately on the drum 7 every one rotation of the crankshaft 14 of the loom.

During this control operation, a F/V converter 22 converts the rotation signal A, namely, a pulse signal, into a corresponding voltage signal and feeds back the voltage signal as a speed feedback signal E to the summing point 20. The speed feedback signal E and the drive controller 21 constitute a speed feedback system, which effectively controls the overshoot of the control operation by increasing the response speed of the feed motor 8.

Figure 2A:
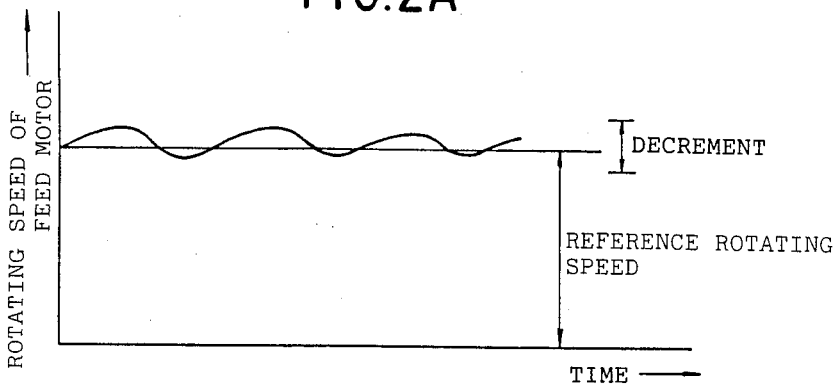
FIG. 2A is a graph showing the mode of controlling the rotating speed of a feed motor.

On the other hand, the drive control unit 3 is provided, as occasion demands, with a reference setting device 23. The reference setting device 23 applies the reference signal F to the summing point 20 when the selective contact 24 is closed. The reference signal F gives a voltage corresponding to the refernce rotating speed to the feed motor 8 to drive the feed motor 8 always for rotation at a predetermined rotating speed. Accordingly, the command control unit 2 controls, as shown in FIG. 2A, only the increment or decrement of the reference signal F to control the drive controller 21 correctively for a small controlled value, which effectively improves the reaction of the drive controller 21 at the start of the weaving operation of the loom.

When the weft yarn feeding device 1 is applied to multiple color picking, the divider 161 is able to divide the rotation signal B according to the number of the picking interval at a dividing ratio set by the dividing ratio setting device 19. Accordingly, in the multiple color picking mode, jump interval control can be changed through a simple electrical operation by adjusting the dividing ratio set by the dividing ratio setting device 19. The divider 161 may be provided in a transmission line for transimtting the rotation signal A. Furthermore, the divider 161 (frequency divider) may be substituted by a divider.

When the loom is stopped, the changeover switch 25 is switched by the controller of the loom from the operation contact 25*a* to the stop contact 25*b*. Consequently, the input of the drive controller 21 is connected to a zero potential point 32 and thereby the potential of the input of the drive controller 21 becomes immediately zero. Consequently, the command signal C' is cut, and thereby the feed motor 8 is stopped instantly. Furthermore, since the operation contact 17 and the selective contact 24 are opened by the controller of the loom when the loom is stopped, the command control unit 2 and the drive control unit 3 remain inoperative during the reverse rotation of the crankshaft 14 and the inching operation of the loom.

Figure 3:
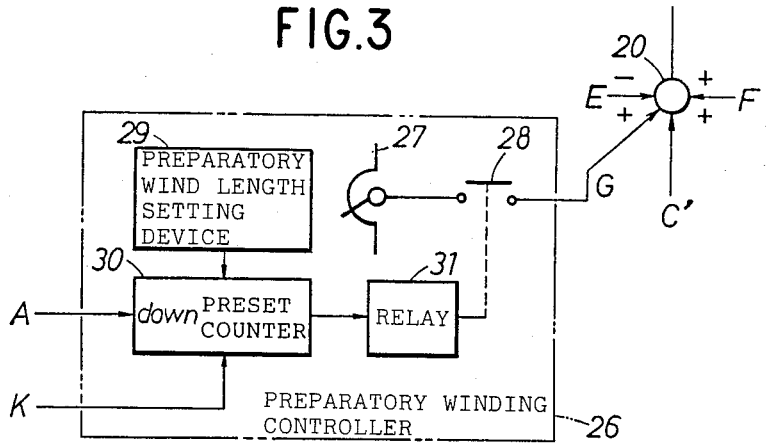
FIG. 3 is a block diagram showing the constitution of a preparatory winding controller.

The drive control unit 3 includes a preparatory winding controller 26 for winding a necessary length of the weft yarn 4 on the drum 7 while the loom is stopped. The preparatory winding controller 26 receives the rotation signal A from the rotation detector 12, and then applies a preparatory winding rotation signal G to the summing point 20. The constitution of the preparatory winding controller 26 is shown in FIG. 3. A preparatory winding rotation signal G is set by a rotating speed setting device 27 and is applied through a relay contact 28 to the summing point 20. On the other hand, a preparatory wind length setting device 29 sets a preparatory wind length corresponding to a predetermined number of picking cycles and applies the preparatory wind length command to one of the inputs of a preset counter 30. Upon the reception of a preparatory winding command signal K, the preset counter 30 drives a relay 31 so that the relay contact 28 is closed. Then, the drive controller 21 drives the feed motor 8 for rotation at a rotating speed corresponding to the preparatory winding rotation signal G to wind the weft yarn 4 on the drum 7 by the rotary yarn guide 6. Meanwhile, the rotation signal A is given to the p reset counter 30 as a signel for subtraction. When the count becomes zero, the preset counter 30 deenergizes the relay 31 to open the relay contact 28. Thus, a necessary length of the weft yarn 4 for preparatory winding is stored automatically on the drum 7.

In this embodiment, the preparatory winding controller 26 controls the feed motor 8 to wind the weft yarn 4 by a fixed length for preparatory storage, when the weft yarn 4 stored on the drum 7 is unwound for some reason while the loom is stopped. However, such a mode of replenishing the weft yarn 4 is unable to store a fixed length of the weft yarn 4 on the drum 7. The drum 7 may be replenished with a length of the weft yarn 4 corresponding to the shortage by giving a signal provided by a known detector for detecting the number of loops unwound from the drum 7 to the set value input of the preset counter 30 or to the input of the counter 131. When the signal is given to the preset counter 30, preparatory winding operation for winding a length of the weft yarn 4 corresponding to the number of unwound loops is carried out upon the reception of the preparatory winding command signal K. When the signal is given to the counter 131, the feed motor 8 is driven for rotation at a rotating speed corresponding to the count of the counter 131 higher than the normal ratating speed when a loom start command signal is given.

Furthermore, in the foregoing embodiment, the rotation detector 12 and the F/V converter 22 constitute the speed feedback control system, however, the speed feedback control system may be substituted by means for generating a voltage proportional to the rotating speed, such as a tachometer generator.

In the foregoing embodiment, the up-down counter 131 is employed as the arithmetic and storage device 13. The up-down counter 131 may be substituted by a counter which receives a signal from the rotation detector 12, a counter which receives a signal from the rotation detector 15, and a comparator which compares the respective output signals of the counters and provides an electric command signal corresponding to the difference between the output signals of the counters. Furthermore, the foregoing functional components may be substituted by a microcomputer.

Second Embodiment (FIGS. 4 to 8):

The second embodiment includes the operation contact 17, the selective contact 24 and the changeover switch 25 of the first embodiment, which are operated by relays to control the rotary motion of the rotary yarn guide 6 for multiple color picking operation.

In this specification, "regular interval picking" designates the regular sequential picking of multiple color weft yarns such as indicated 1×1, 1×2, and "free interval picking" designates an irregular picking of multiple color weft yarns.

The second embodiment is intended to drive a feed motor 8 continuously at least in the regular sequential picking operation of the multiple color loom so that the heat generation of the feed motor 8 due to frequent on-off operation is reduced. In the second embodiment, a reference number of rotation for the rotary yarn guide 6 proportional to the number of rotation of the crankshaft 14 of the loom is set, and the feed motor 8 is controlled on the basis of the difference between the reference number of rotation for the rotary yarn guide 6 and an actual number of rotation of the same so that the rotary operation of the rotary yarn guide 6 conform to the operation of the multiple color loom. In the free interval picking mode, the feed motor 8 is actuated in synchronism with a weft yarn selection signal commanding the selection of the weft yarn which is to be fed by the relevant weft yarn feeding device. In the regular sequential picking mode, the feed motor 8 is driven continuously for rotation at an appropriate rotating speed on the basis of an operation signal H representing the mode of operation of the multiple color loom.

Figure 4:
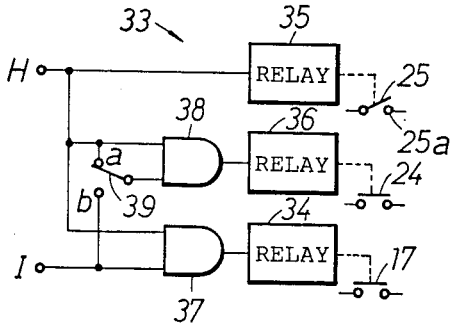
FIG. 4 is a block diagram of a control unit.

An operation contact 17, a selective contact 24 and a changeover switch 25, which are the same in function as those of the first embodiment, are operated by relays 34, 36 and 35 of a changeover control unit 33 illustrated in FIG. 4, respectively. The relay 34 is connected to the output of an AND gate 37 which receives the operation signal H of the loom at one of the inputs thereof and a weft yarn selection signal I at the other input thereof. The operation signal H of the loom is given directly to the relay 35. The relay 36 is connected to the output of an AND gate 38 which receives the operation signal H at one of the inputs thereof. The operation signal H or the weft yarn selection signal I is applied selectively to the other input of the AND gate 38 through a changeover switch 39. In this embodiment, the changeover switch 39 is changed over manually to a terminal a to apply the operation signal H to the AND gate 38 in the regular interval picking mode, and to a terminal b to apply the weft yarn selecion signal I to the AND gate 39 in the free interval picking mode.

Figure 5:
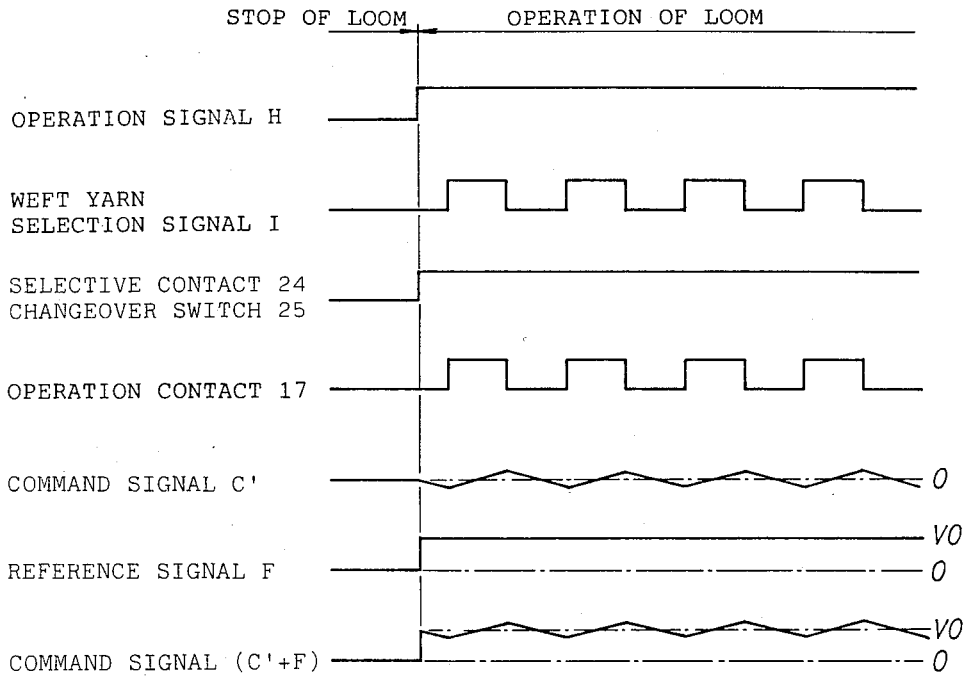
FIGS. 5 and 6 are time charts showing signals and modes of operation of relays for a fixed picking mode and a free picking mode.

In the regular interval picking mode, the changeover switch 39 is switched to the terminal a. As illustrated in FIG. 5, the operation signal H is provided as soon as the loom starts operating, while the weft yarn selection signal I is given periodically in synchronism with the selection of the weft yarn to be fed by the weft yarn feeding device. Accordingly, the relay 35 is driven directly by the operation signal H and the relay 36 is driven by the output signal of the AND gate 38 to keep the changeover switch 25 and the selective contact 24 closed, respectively. The relay 34 is driven by the output of the AND gate 37 in synchronism with the weft yarn selection signal I to close the operation contact 17 in synchronism with the weft yarn selection signal I. A DA converter 18 provides a cmmand signal C′ for correcting the rotating speed of the output shaft of the feed motor 8 so that the actual rotating speed coincides with a reference rotating speed. A command signal C′+F (FIG. 5) is given to a drive controller 21. Therefore, feed motor 8 is driven continuously so that the rotating speed of the output shaft thereof varies periodically and smoothly substantially around the fixed reference rotating speed.

Figure 6:
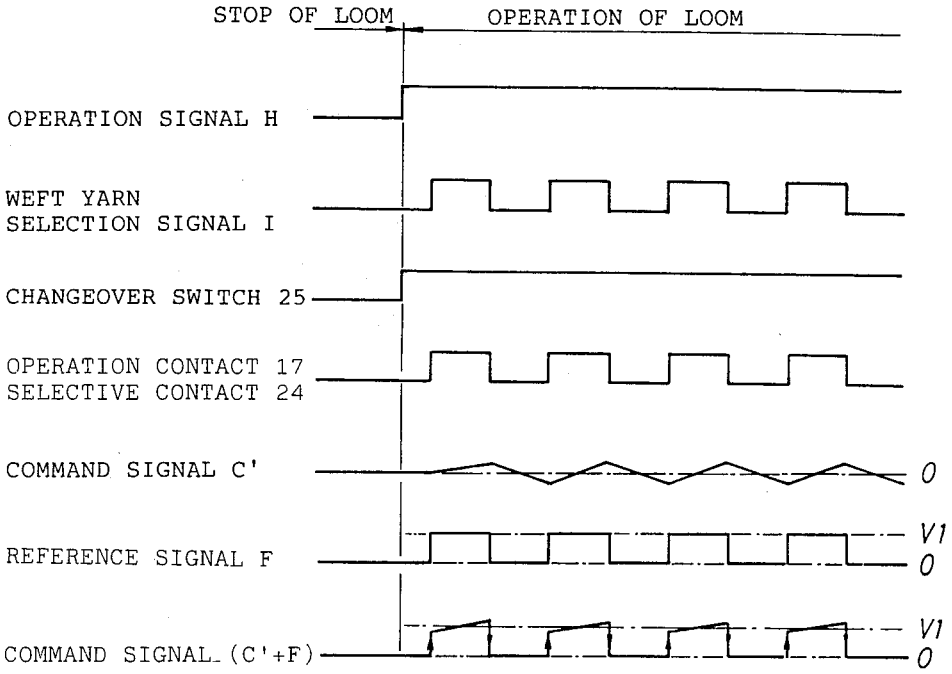

In the free interval picking mode, the changeover switch 39 is switched to the terminal b. As illustrated in FIG. 6, the relay 35 is energized continuously while the loom is operating to keep the changeover switch 25 closed, while the relays 34 and 36 are energized by the output signals of the AND gates 37 and 38, respectively, in synchronism with the weft yarn selection signal I, so that the operation contact 17 and the selective contact 24 are closed in synchronism with the weft yarn selection signal I. Accordingly, the feed motor 8 is driven by the command signal C'+F in synchronism with the weft yarn selection signal I. The refernce rotating speed of the feed motor 8 for the regular interval picking mode and that for the free interval picking mode are different from each other; the voltage V0 of a reference signal F for the regular interval picking mode is, for example, approximately half the voltage V1 of the reference signal F for the free interval picking mode.

Figure 7:
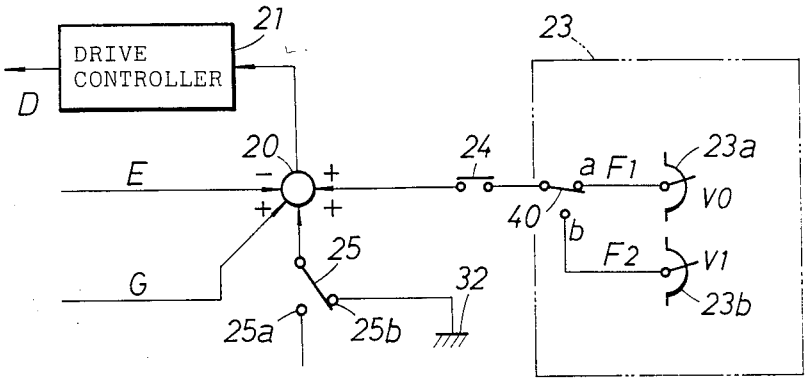
FIG. 7 is a block diagram showing the constitution of a weft yarn feeding device, in a second embodiment, according to the present invention.
Figure 8:
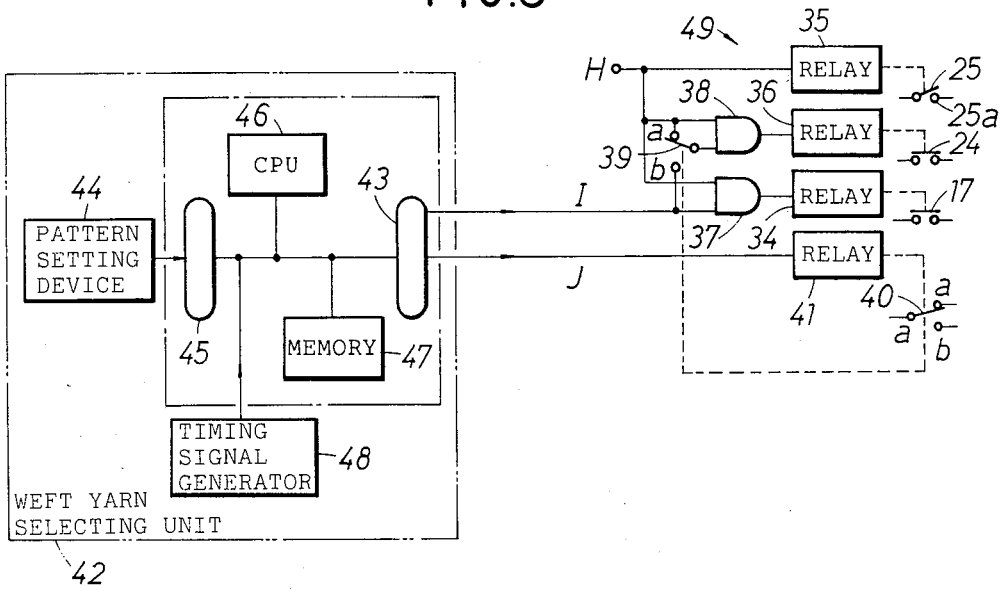
FIG. 8 is a block diagram showing the constitution of a changeover control unit of the weft yarn feeding device of FIG. 7.

FIGS. 7 and 8 illustrate a modification of the second embodiment. As illustrated in FIG. 7, two reference roation signal generators 23*a* and 23*b* are provided as a reference setting device 23. A changeover switch 40 connects the reference rotation signal generators 23*a* and 23*b* selectively to a selective contact 24. The reference rotation signal generators 23*a* and 23*b* provide a reference rotation signal F1 of V0 voltage for the regular interval picking mode and a reference rotation signal F2 of V1 voltage for the free interval picking mode, respectively. The changeover switch 40 is switched to the terminal a in the regular interval picking mode and to the terminal b in the free interval picking mode to connect the reference rotation signal generator 23*a* and to connect the reference rotation signal generator 23*b* to the selective contact 24, respectively. As illustrated in FIG. 8, the changeover switches 39 and 40 are operated by a relay 41 of a changeover control unit 49. A drive mode changeover signal J is applied through the output port 43 of the weft yarn selecting unit 42 of the loom to the relay 41. In the regular interval picking mode, the changeover switches 39 and 40 are switched to the terminals a, respectively. In the free interval picking mode, the changeover switches 39 and 40 are switched to the terminals b, respectively. The weft yarn selecting unit 42 reads a picking mode selection pattern set by a pattern setting device 44 and stored by a central processing unit 46 in a memory 47, in synchronism with a timing signal generated by a timing signal generator 48, and then provides the weft yarn selection signal I and the drive mode changeover signal J through an output port 43 thereof. Changeover between the regular interval picking mode and the free interval picking mode can simply be achieved without changing the setting mode of the reference setting device 23, and the drive mode for driving the feed motor 8 can automatically be changed by reading a weft yarn selection pattern beforehand from the weft yarn selecting unit 42.

While the loom is operating in the free interval picking mode, even if the weave of the fabric to be woven on the loom requires frequent on and off of the weft yarn selection signal I of the weft yarn selecting unit 42 as in the regular interval picking mode, the weft yarn selection pattern stored in the memory 47 of the weft yarn selecting unit 42 is read beforehand to change automatically the feed motor driving mode and to change over between the reference rotation signals F1 and F2 automatically only while the weave of the fabric requires picking cycles similar to those in the regular interval picking mode.

In the second embodiment, signals are controlled by switches having contacts. Naturally, those switches may be substituted by contactless switches, and hence the relays may be substituted by driving devices such as switching transistors.

As apparent from the foregoing description, in the second embodiment, the feed motor 8 is driven continuously according to the operation signal H by applying the reference rotation signals F (F1, F2) to the drive controller 21 through the changeover switch 39 in synchronism with the operation signal H of the loom during operation in the regular interval picking mode, so that the rotating speed of the output shaft of the feed motor 8 varies moderately within a small range about a fixed reference rotating speed without sharp variation as under on-off control. Accordingly, excessive current will not flow through the feed motor 8, and thereby the generation of heat in the feed motor 8 is suppressed. Furthermore, the adverse effect of the sharp variation of the rotating speed of the output shaft of the feed motor on the weft yarn stored on the drum is obviated.

Third Embodiment (FIGS. 9 to 12):

The third embodiment is intended to control the weft yarn winding operation so that a fixed length of the weft yarn is wound automatically on a measuring and storing drum 7 prior to starting the loom.

The preparatory winding controller 26 of the first embodiment is unable to cope with the malfunction of the feed motor 8 due to an accident to the preparatory winding control system or the run-away of the feed motor 8. The feed motor 8 becomes inoperative, for example when the rotary yarn guide 6 is caught by something, when the output line for the preparatory winding rotation signal G is broken or when the connectors of the output line for the preparatory winding rotation signal G are not connected firmly. Particularly, when the feed motor 8 is locked mechanically, the feed motor 8 will be broken or burnt by heat. When the rotation signal A is not provided due to the malfunction or the false adjustment of the rotation detector 12, when the output line for the rotation signal A is broken or when the connectors of the output line for the rotation signal A are not connected firmly, the feed motor 8 runs away. Consequently, the weft yarn 4 is wound continuously on the drum 7 to waste the weft yarn 4 and the weft yarn excessively wound on the drum 7 interferes with the rotary yarn guide 6 to lock the feed motor 8 mechanically.

In the third embodiment, the feed motor 8 is stopped and an alarm is given to inform the operator of the abnormal condition of the preparatory winding control system when the preparatory winding of the weft yarn 4 is not completed within a fixed period of time due to the above-mentioned causes.

The third embodiment comprises a preparatory winding control unit 50 provided with a preparatory winding monitoring timer 51, which gives a preparatory winding rotation signal G to a drive controller 21 upon the reception of a preparatory winding command signal K, detects the number of rotation of the output shaft of the feed motor 8 and interrupts the preparatory winding rotation signal G when a fixed number of loops of the weft yarn 4 is wound on the drum 7. When the duration of the preparatory winding rotation signal G exceeds a predetermined time because the preparatory winding is not completed within a fixed time, the preparatory winding monitoring timer 51 provides an output signal to interrupt the preparatory winding rotation signal G so that the feed motor 8 is stopped. The output signal of the preparatory winding monitoring timer is given to an external device which gives an alarm signal upon the reception of the output signal of the preparatory winding monitoring timer 51.

Figure 9:
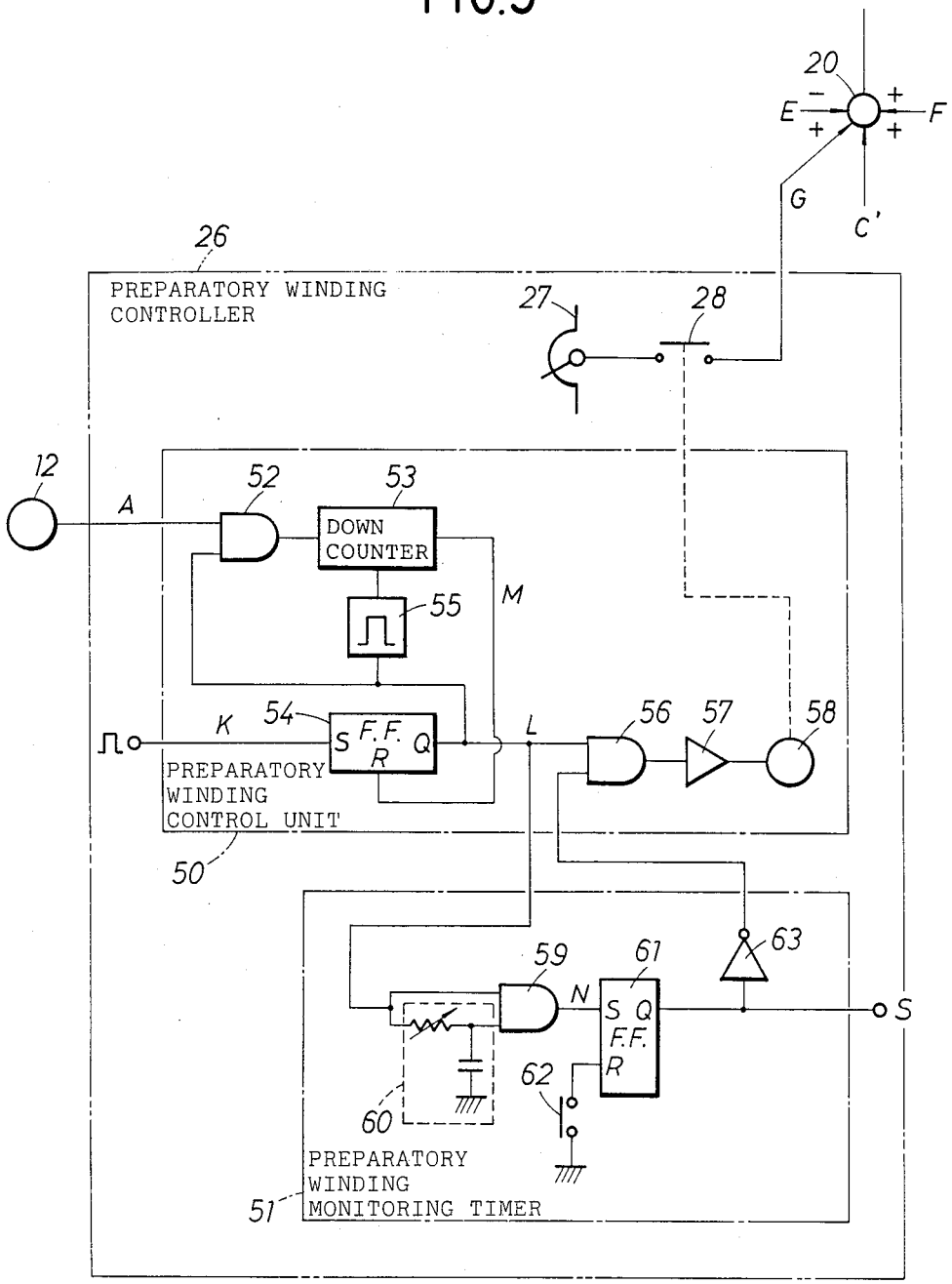
FIG. 9 is a block diagram showing the constitution of a preparatory winding control unit capable of operating time monitoring timer function, according to the present invention.

FIG. 9 illustrates the constitution of the preparatory winding control unit 50 and the preparatory winding monitoring timer 51 in association with the relevant part of the preparatory winding controller 26. The rotation detector 12 is connected to one of the inputs of the AND gate 52 of the preparatory winding control unit 50. The output of the AND gate 52 is connected to one of the inputs of a preset down counter 53. A preparatory winding command signal K is applied to the set input of a flip-flop circuit 54. The reset input of the flip-flop circuit 54 is connected to the output of the down counter 53. The output of the flip-flop circuit 54 is connected to the other input of the AND gate 52, to the other input of the down counter 53 through a one-shot multivibrator 55 and to one of the input of an AND gate 56. The AND gate 56 is connected through a driver 57 to a relay 58 which operates a relay contact 28.

On the other hand, the output line of the flip flop circuit 54 is branched and the branch line is connected to one of the inputs of the AND gate 59 in an operation time monitoring timer section and to the other input of the AND gate 59 through a R-C time constant circuit 60. The output of the AND gate 59 is connected to the set input of a flip-flop circuit 61. A reset switch 62 is connected to the reset input of the flip-flop circuit 61. The output of the flip-flop circuit 61 is connected through a NOT circuit 63 to the other input of the AND gate 56 of the preparatory winding control unit 50. The output of the flip-flop circuit 61 can be connected to an external device.

Figure 10A:
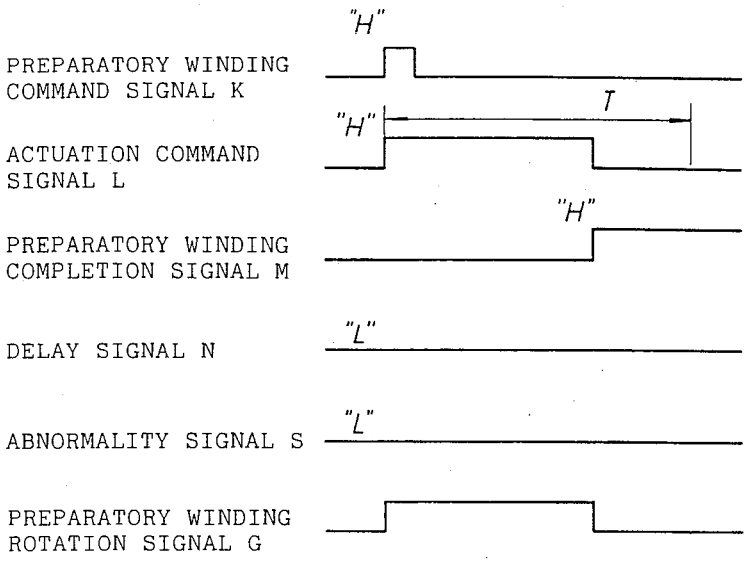
FIG. 10A is a time chart showing the mode of operation of the preparatory winding control unit for normal preparatory winding operation.

The manner of preparatory winding control operation during the normal operation of the weft yarn feeding device will be described with reference to a time chart shown in FIG. 10A.

As mentioned above, an appropriate length of the weft yarn 4 must be wound on the drum 7 for the first picking cycle after the loom has been started, before the loom is started, for example, for weave adjustment while the loom is stopped.

Upon the reception of a preparatory winding command signal K of H-level while the loom is stopped, the flip-flop circuit 54 of the preparatory winding control unit 50 gives an actuation command signal L of H-level through the AND gate 56 and the driver 57 to the relay 58. At this moment, the NOT circuit 63 provides an output signal of H-level. Upon the reception of the actuation command signal L, the relay 58 closes the relay contact 28. Consequently, the rotating speed setting device 27 provides a preparatory winding rotation signal G to actuate the drive controller 21 so that the feed motor 8 is driven. Thus, the weft yarn 4 is wound on the drum 7 before starting the loom. The length of the weft yarn 4 wound on the drum 7 is detected through the detection of the number of rotation of the output shaft of the feed motor 8 by the rotation detector 12. The rotation detector 12 feeds back a rotation signal A, namely, a detection signal corresponding to the number of rotation of the output shaft of the feed motor 8, to the preparatory winding control unit 50 and is applied through the AND gate 52 to the down counter 53. While the actuation command signal L is on H-level, the AND gate 52 keeps feeding the rotation signal A to the down counter 53. Upon the reception of the actuation command signal L from the one shot multivibrator 55, the down counter 53 is preset for a count corresponding to a predetermined number of loops of the weft yarn 4 by a known method. Supposing that the count and the predetermined number of loops are, for example, three hundreds and three, respectively, the down counter 53 counts down three hundreds pulses of the rotation signal A. When the count becomes zero, the down counter 53 gives a preparatory winding completion signal M to the reset input of the flip-flop circuit 54. Then, the flip-flop circuit 54 interrupts the actuation command single L to open the relay contact 28. Consequently, the feed motor 8 is stopped to complete the preparatory winding of the weft yarn 4.

On the other hand, prior to the preparatory winding operation, the reset switch 62 of the preparatory winding monitoring timer 51 is closed and the flip-flop circuit 61 is reset so that the output signal of the flip-flop circuit 61 is on L-level. Accordingly, the NOT circuit 63 gives an output signal of H-level to the AND gate 56 of the preparatory winding control unit 50. Therefore, while the flip-flop circuit 61 is reset, the actuation command signal L is provided by the AND gate 56. Thus, the normal preparatory winding operation is carried out.

The manner of operation of the preparatory winding controller in case of the abnormal preparatory winding operation of the weft yarn feeding device will be described hereinafter with reference to a time chart shown in FIG. 10B.

Upon the occurence of the abnormal preparatory winding operation as mentioned above, in which the down counter 53 does not provide the preparatory winding completion signal M and the actuation command signal L remains on H-level after the set time T set by the timer has elapsed, the actuation command signal L of H-level given to the preparatory winding monitoring timer 51 is applied directly to one of the inputs of the AND gate 59, and through the R-C time constant circuit 60 to the other input of the ABD gate 59 after the time T has elapsed. Then, the AND gate 59 gives a delay signal N of H-level with delay to the flip-flop circuit 61 to set the flip-flop circuit 61. Then, the NOT circuit 63 gives an output signal of L-level to the AND gate 56. At the same time, the output signal of H-level of the flip-flop circuit 61 is given also to an external device as an abnormality signal S. Thus, the actuation command signal L of the AND gate 56 is interrupted to cancel the feed motor drive command.

Figure 11:
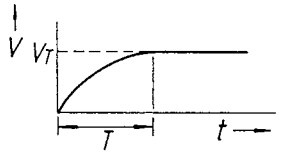
FIG. 11 is a waveform diagram showing the waveform of the output signal of the R-C time constant circuit of a monitoring timer unit.

The set time T corresponds to a time interval between a moment when the actuation command signal L is provided and a moment when the delay signal N is provided. As illustrated in FIG. 11, the set time T is equivalent to a time interval between a time when the actuation command signal L is given to the R-C time constant circuit 60 and a time when the output signal of the R-C time constant circuit 60 exceeds the threshold level $V_T$ of the AND gate 59. AT the moment when the output signal of the R-C time constant circuit exceeds the threshold level $V_T$, the AND gate 59 provides the delay signal N. Naturally, the moment when the set time T elapses is later than the moment when the preparatory winding completion signal M is to be provided.

Figure 12:
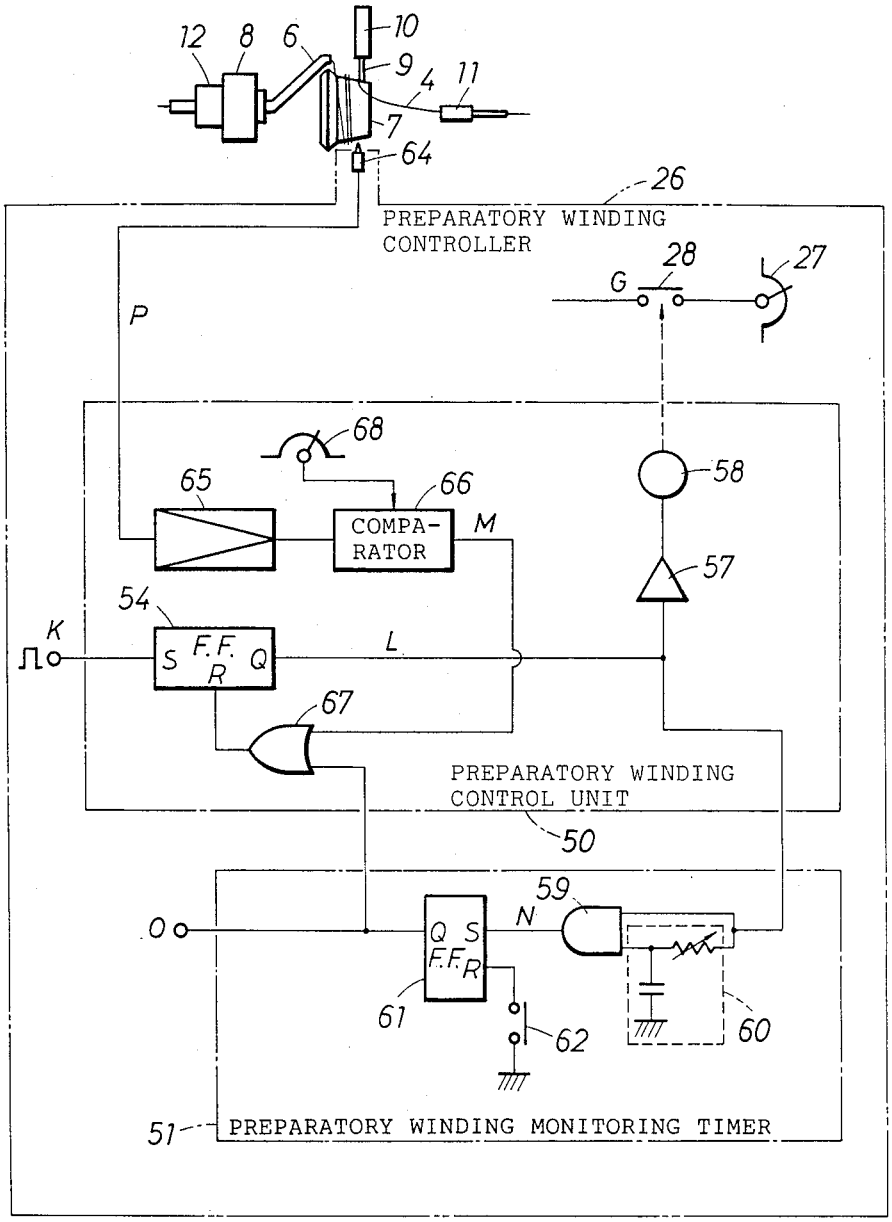
FIG. 12 is a block diagram showing the constitution of a weft yarn feeding device, in a third embodiment, according to the present invention.

FIG. 12 illustrates a modification of the third embodiment. The third embodiment (FIG. 9) detects the length of the weft yarn 4 wound on the drum through the detection of the number of rotation of the output shaft of the feed motor 8 by the rotation detector 12 and, in case of abnormal preparatory winding operation, the flip-flop circuit 54 interrupts the actuation command signal L.

In the modification shown in FIG. 12, the length of the weft yarn 4 wound on the drum 7 is detected through the detection of the weft yarn 4 at a predetermined position on the drum by a photoelectric sensor 64 disposed adjacent to the circumference of the drum 7 at a position corresponding to the predetermined position. In case of abnormal preparatory winding operation, the flip-flop circuit 54 is reset to interrupt the actuation command signal L.

This modification of the third embodiment is formed in the following constitution. The photoelectric sensor 64 is connected through an amplifier 65 to one of the inputs of a comparator 66. The output of the comparator 66 is connected to one of the inputs of an OR gate 67. A reference setting device 68 is connected to the other input of the comparator 66. The output of the OR gate 67 is connected to the reset input of the flip-flop circuit 54. The output of the flip-flop circuit 54 is connected through the driver 57 to the relay 58. The output of the flip-flop circuit 61 is connected also to the other input of the OR gate 67. The other respect of the constitution is the same as that of the third embodiment, therefore, the description thereof will be omitted.

The manner of operation of the modification shown in FIG. 12 in case of the normal preparatory winding operation of the weft yarn feeding device will be described with reference to the time chart shown in FIG. 10A.

When the preparatory winding command signal K of H-level is given to the flip-flop circuit 54, the actuation command signal L is given through the driver 57 to the relay 58 to actuate the feed motor 8.

The photoelectric sensor 64 disposed at a fixed position adjacent to the circumference of the drum 7 detects whether or not the weft yarn 4 is wound to a position on the drum 7 corresponding to the fixed position, and gives a detection signal P through the amplifier 65 to the comparator 66. The comparator 66 compares the detection signal P with a reference signal of an optional level given thereto by the reference setting device 68. Upon the coincidence of the detection signal P and the reference signal, namely, upon the completion of winding a predetermined length of the weft yarn 4 on the drum, the comparator 66 gives the preparatory winding completion signal M through the OR gate 67 to the reset input of the flip-flop circuit 54. Upon the reception of the preparatory winding completion signal M, the flip-flop circuit 54 interrupts the actuation command signal L to stop the feed motor 8. Thus, the preparatory winding operation is accomplished.

On the other hand, prior to the preparatory winding operation, the flip-flop circuit 61 is reset to give an output signal of L-level to the OR gate 67, as mentioned above.

The manner of operation of the modification in case of the abnormal preparatory winding operation of the weft yarn feeding device will be described with reference to the time chart shown in FIG. 10B.

Figure 10B:
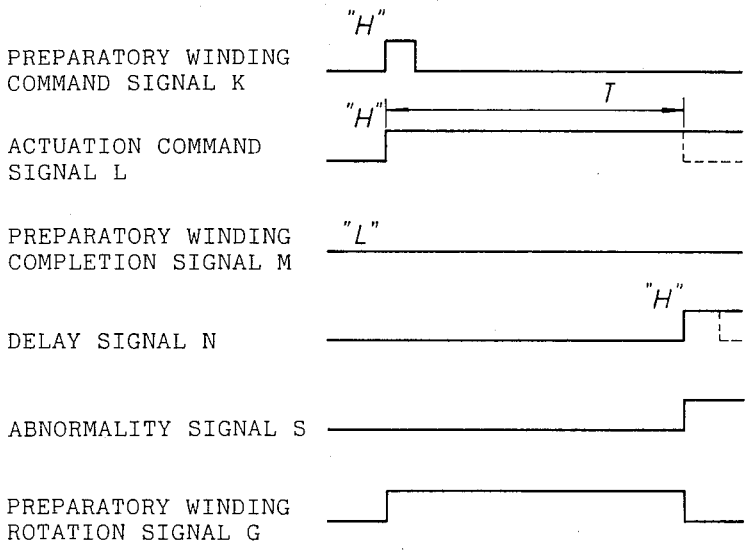
FIG. 10B is a time chart showing the mode of operation of the preparatory winding control unit for abnormal preparatory winding operation.

In this case, the actuation command signal L and the delay signal N are indicated by broken lines in FIG. 10B.

When the preparatory winding completion signal M is not provided and the actuation command signal remains on H-level due to the abnormal preparatory winding operation, the delay signal N is provided after the elapse of the set time T set by the preparatory winding monitoring timer 51 to set the flip-flop circuit 61. Then, the flip-flop circuit 61 gives an output signal of H-level through the OR gate 67 to the flip-flop circuit 54. At the same time, the output signal of the flip-flop circuit 61 is given to an external device as an abnormality signal S. At this moment, the flip-flop circuit 54 is reset to interrupt the actuation command signal L.

Thus, in the third embodiment, the preparatory winding monitoring timer 51 provides a signal to interrupt the actuation command signal L and to display the abnormal preparatory winding operation on the external device when the actuation command signal L remains on H-level after the elapse of a fixed time. Therefore, the run-away of the feed motor 8 and the resulting waste of the weft yarn 4 attributable to the abnormal preparatory winding operation, and the damage or burning of the feed motor 8 due to the mechanical locking of the same are prevented.

Fourth Embodiment (FIGS. 13 to 15):

The fourth embodiment relates to the modification of the signal converter 16 employed in the first embodiment.

In controlling the length of the weft yarn 4 wound on the drum 7, the number of pulses of the rotation signal B for one rotation of the crankshaft 14 of the loom and the number of pulses of the rotation signal A corresponding to the number of rotation of the rotary yarn guide 6 required for winding a length of the weft yarn 4 necessary for one picking cycle must coincide with each other. The first embodiment is provided with the divider 161 in the signal transmission line to equalize the rotation signal B representing the rotation of the crankshaft 14 of the loom with the rotation signal A representing the rotation of the output shaft of the feed motor 8 for driving the rotary yarn guide 6 in the number of pulses. When the width of the fabric to be woven on the loom is changed, namely, when the length of the weft yarn for one picking cycle needs to be changed, the dividing ratio is changed to equalize the rotation signal B with the rotation signal A in the number of pulses.

Suppose that the rotation detector 15 provides a pulse signal of a pulse number p1 for one rotation of the crankshaft 14 of the loom, the number of rotation of the output shaft of the feed motor 8 for winding a length of the weft yarn necessary for one picking cycle is n, the number of pulses produced for every one rotation of the output shaft of the feed motor 8 is p2, and the dividing ratio is m. Then, the control system must meet the following equations.

$$p1/m = p2 \times n$$

or $$p1/n = p2 \times m$$

since p1, p2, m and n are positive integers, p1/n is a positive integer. If, for example, p2=4, the value of p1 meeting all the cases where n=2 to 8 is 3360 which is (the least common multiple of 2, 3, 4, 5, 6, 7 and 8)×4.

Thus, when a pulse signal divider is employed, the rotation detector 15 must be capable of producing 3360 pulses for one rotation of the crankshaft of the loom. Generally, such a resolution is higher than that of a universal rotation detector employed in the control system of the loom. Hence, the employment of such a divider is disadvantageous in respect of effect under the high-speed operation of the loom and in the cost of the control system.

When the width of the fabric to be woven on the loom is changed, the rotation detetor 15 may be changed for another rotation detector. However, changing one rotation detetor for another requires much time for replacement and various rotation detectors must be prepared for replacement, and hance such a means is not a practically effective means.

The fourth embodiment is intended to readily cope with the change of weaving width, namely, the change of the number of loops of the weft yarn for one picking cycle, by electrical setting means without requiring the excessive increase of the number of pulses to be produced by the rotation detector 15 for one rotation of the crankshaft of the loom.

Figure 13:
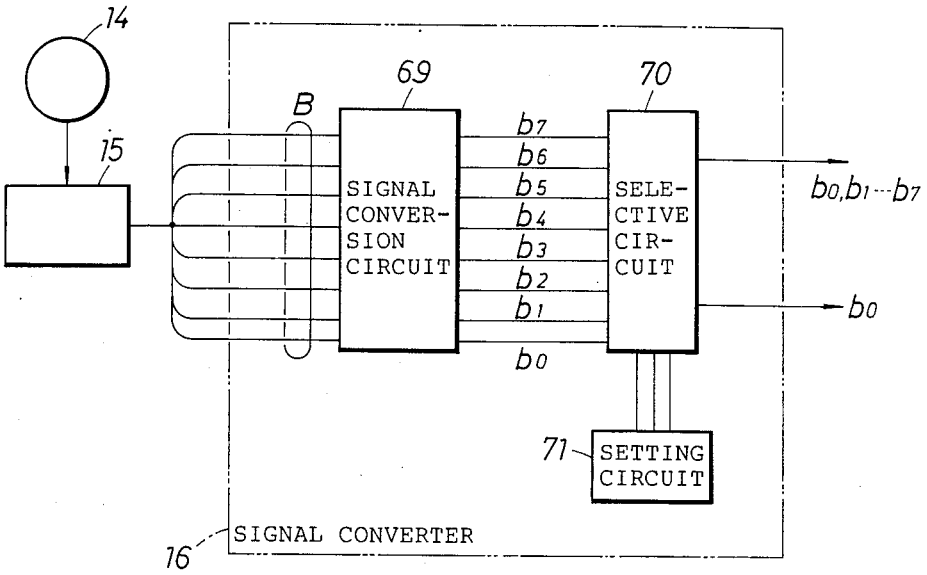
FIG. 13 is a block diagram showing the constitution of a signal converter.

In the fourth embodiment, the divider 161 of the first embodiment is substituted by a signal conversion circuit, which converts the rotation signal B provided by the rotation detector 15 into a plurality of pulse signals of differnt patterns necessary for controlling the length of the weft yarn wound on the drum, and then gives only one necessary pulse signal among those pulse signals to the arithmetic and storage device 13. Preferably, the signal conversion circuit comprises a ROM capable of optionally setting the period of the pulse signal in a unit corresponding to the least resolution of the rotation detector 15. Accordingly, when the weaving width is changed, namely, when thelength of the weft yarn necessary for one picking cycle is changed, the operating mode of the control system can simply be changed through the appropriate selection of the output signal of the signal conversion circuit even if the rotation detector 15 is capable of producing a pulse signal of a comparatively few pulse number for one rotation of the crankshaft of the loom. As illustrated in FIG. 13, the signal converter 16 comprises a signal conversion circuit 69 connected to the rotation detector 15, a selective circuit 70 connected to the output of the signal conversion circuit 69, and a setting circuit 71 connected to the selective circuit 70.

Figure 14:
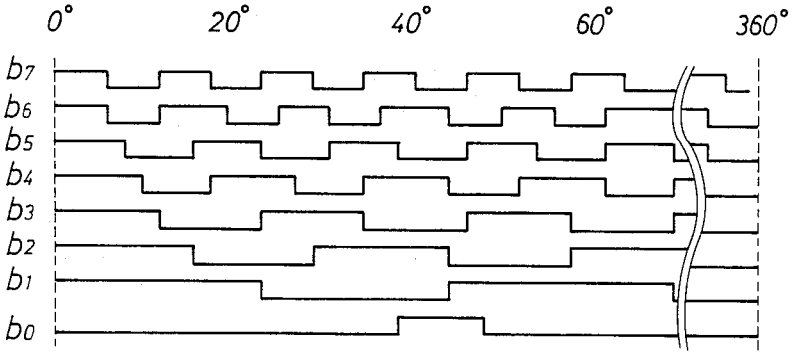
FIG. 14 is a waveform diagram of pulse signals.

The signal conversion circuit 69 is a programmable memory device, for example, an 8-bit ROM, or a logic circuit. The signal conversion circuit 69 receives an 8-bit rotation signal B from the rotation detector 15 and produces eight kinds of pulse signals b0, b1, . . . , b6 and b7 of a duty factor appropriate for controlling the length of the weft yarn to be wound on the drum, according to the pattern of the rotation signal B. The output pattern can optionally be set in a unit corresponding to the least resolution of the rotation detector 15 in writing program data in the ROM. As illustrated in FIG. 14, the pulse signals b0, b1, . . . , b6 and b7 have 1, 8, 12, 16, 20, 24, 28 and 32 H-level pulses, respectively, for one rotation of the crankshaft 14 of the loom. The selective circuit 70 is, for example, a multiplexer.

As the crankshaft 14 of the loom rotates, the rotation detector 15 gives a digital rotation signal B to the signal converter 16. Then, the signal converter 16 produces a plurality of pulse signals b0, b1, . . . , b6 and b7 corresponding to the angle of rotation of the crankshaft 14. As illustrated in FIG. 14, the pulse signals b0, b1, . . . , b6 and b7 have predetermined patterns, respectively, for one rotation of the crankshaft 14. The patterns and relative phases of the pulse signals can optionally be determined. Once the patterns and relative phases are set, the same remains unchanged.

Suppose that four loops of the weft yarn 4 is necessary for one picking cycle and the rotation detector 12 produces four rotation signals A for one rotation of the rotary yarn guide 6. Then, the number of pulses necessary for measuring the length of the weft yarn 4 necessary for one picking cycle is sixteen. Therefore, the selective circuit 70 selects the fourth pulse signal b3 having sixteen pulses among the eight pulse signals b1 to b7 in conformity with the command of the setting circuit 71 and the fourth pulse signal is applied to the up-input of a counter 131 serving as the arithmetic and storing device 13. The pulse signal b3 has sixteen pulses of H-level for one rotation of the crankshaft 14. Accordingly, the pulse signals each having sixteen pulses are applied sequentially to the up-input of the counter 131 at every one rotation of the crankshaft 14. A command signal C representing the count of the counter 131 is converted into a corresponding analog command signal C' by a DA converter 181.

Meanwhile, the rotation detector 12 detects the rotation of the rotary yarn guide 6 and applies the rotation signals A each having sixteen pulses for four rotations of the rotary yarn guide 6 sequentially to the down-input of the counter 131. Consequently, the command signal C is counted down sequentially to zero. The control mode including such a series of control operations is a kind of follow-up control mode.

When the weaving width, hence the length of the weft yarn 4 necessary for one picking cycle, is increased, the pulse signal b3 is changed for one of the pulse signals b4, b5, b6, and b7 each having a greater number of pulses for one rotation of the crankshaft 14 than that of the pulse signal b3. As apparent from the foregoing description, the selection of an appropriate pulse signal among those signals can readily be achieved through electrical procedure by operating the setting circuit 71. On the contrary, when the weaving width is reduced or when the weft yarn feeding device 1 is used for the interval picking operation in multiple color weaving operation, the pulse signals b0, b1, and b2 each having pulses less than those of the pulse signal b3.

As mentioned above, the signal converter 16 of the fourth embodiment includes the 8-bit signal conversion circuit 69 capable of providing eight pulse signals of different patterns, respectively. When the pulse signals b0, to b7 are unable to cope with the variation of the weaving width or interval picking operation, the signal conversion circuit 69 is replaced with another signal conversion circuit. Thus, the signal converter is able to cope flexibly with various picking modes.

Naturally, a 16-bit signal conversion circuit 69 is able to cope with sixteen picking modes. The pulse signal b0 having one pulse for one rotation of the crankshaft 14 is used for the synchronous control of the components of the loom.

Figure 15:
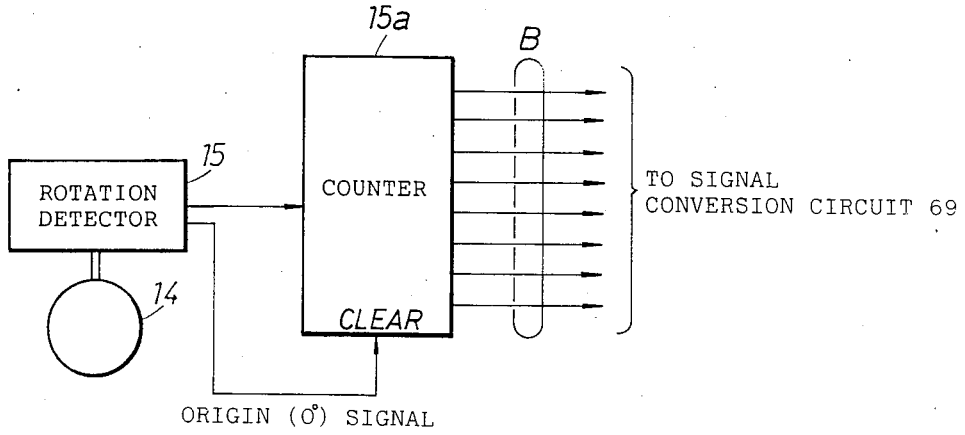
FIG. 15 is a block diagram showing the constitution of an incremental rotation detector.

The rotation detector 15 may be of the incremental type encoder capable of indexing the origin. When an incremental type rotation detector is employed, the pulses of the pulse signal provided by the rotation detector 15 are counted by a counter **15*a* to provide an 8-bit rotation signal B corresponding to the angle of rotation (FIG. 15). The count (the rotation signal B) of the counter 15*a* is cleared by an origin signal which is provided every one rotation of the crankshaft 14**.

The fourth embodiment provides the following particular effects.

Since the signal converter 16 provides a plurality of pulse signals having different patterns of a pulse width in a unit corresponding to the least resolution of the rotation detector 15, the control system is able to cope with the change of the number of rotation of the rotary yarn guide 6 necessary for one picking cycle due to the change of the weaving width or that of the picking mode for multiple color picking operation through the electrical adjustment of the signal converter 16.

Furthermore, since the mode of the output signal of the signal converter 16 can optionally be set previously in a unit corresponding to the least resolution of the rotation detector 15, the number of pulses of the pulse signal provided by the rotation detector 15 may be comparatively small. Accordingly, the fourth embodiment does not require an exensive high-resolution rotary encoder; an absolute type encoder for detecting the angle of rotation of the crankshaft of the loom may be employed as the rotation detector 15.

Still further, the employment of a programmable memory device as the principal component of the signal converter 16 enables optional setting of the patterns of the pulse signals, and the replacement of the memory device enables flexible application of the signal converter 16 to the wider variation of the picking mode.

Fifth Embodiment (FIGS. 16 to 18):

The fifth embodiment is intended to regulate the input timing of the rotation signal B. The first embodiment uses the operation signal as a signal to operate the operation contact 17 for regulating the timing for reading or interrupting reading the rotation signal B, and hence the timing of producing the rotation signal B is not determined in time-relation to the operation signal H. Accordingly, it is possible that the feed motor 8 is not controlled properly and insufficient or excessive weft yarn is wound on the drum 7 due to the discrepancy between the actual angle of rotation of the crankshaft of the loom and the angle of rotation of the same represented by the rotation signal B particularly at the start and stop of the loom.

Accordingly, the fifth embodiment is designed to obviate disagreement between the actual number of rotation of the crankshaft of the loom and the detected number of rotation of the same by regulating an effective period for reading the rotation signal B by a timing pulse produced every fixed angle of rotation of the crankshaft of the loom.

The fifth embodiment comprises a pulse generator which generates a timing pulse every fixed angle of the crankshaft of the loom, and a timing circuit which regulates an effective period of reading the rotation signal B by the timing pulse, so that the rotation signal B can be read only in the effective period regulated by the timing pulse even if there is a time differnce between the operation signal H and the rotation signal B at the start and stop of the loom. Therefore, disagreement between the actual number of rotation of the crankshaft of the loom and the detected number of rotation of the same can effectively obviated.

Figure 16:
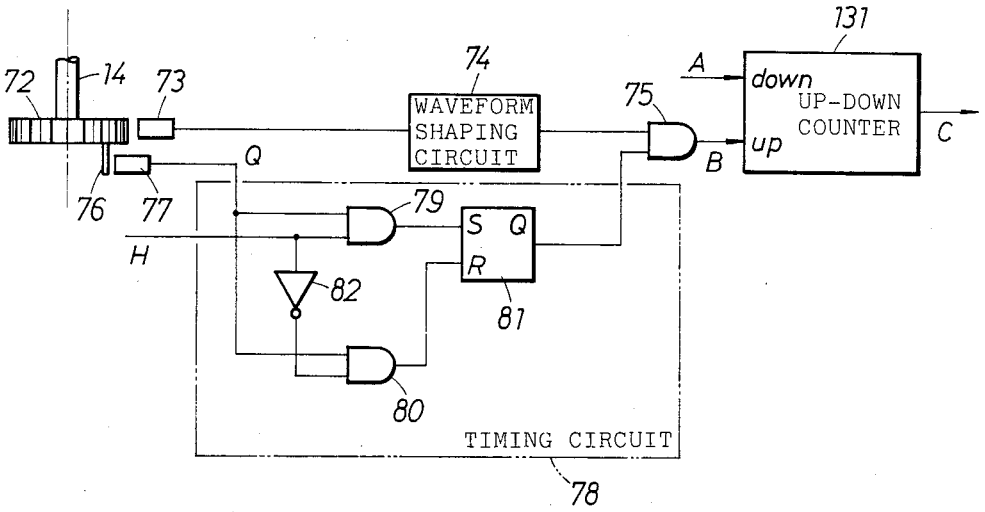
FIG. 16 is a block diagram showing the constitution of a timing circuit.

As illustrated in FIG. 16, a contactless switch 73 is disposed opposite to the circumference of a gear 72 secured to the crankshaft 14 of the loom. The output of the contactless switch 73 is connected through a waveform shaping circuit 74 to an AND gate 75 to give the rotation signal B to the AND gate 75. The output of the AND gate 75 is connected to the up-input of the counter 131. A pin 76 projecting from one side surface of the gear 72 and a contactless switch 77 disposed near the circular path of the pin 76 constitute a pulse generator serving the rotation detector 15 which generates a timing pulse Q at a fixed crankshaft angle of the loom. The angular position of the pin 76 on the gear 72 is discretional except that the angular position of the pin 76 is determined with respect to the teeth of the gear 72 so that there is a time difference between the pulse train of the rotation signal B and the timing pulse Q. The output of the contactless switch 77 is connected to the two AND gates 79 and 80 of a timing circuit 78. The output of the AND gates 79 and the output of the AND gate 80 are connected to the set terminal and the reset terminal of a flip-flop circuit 81, respectively. The output of the flip-flop circuit 81 is connected to the input of the AND gate 75. The operation signal H is applied to the timing circuit 78; the operation signal H is given directly to the AND gate 79 and through an inverter 82 to the AND gate 80.

Figure 17:
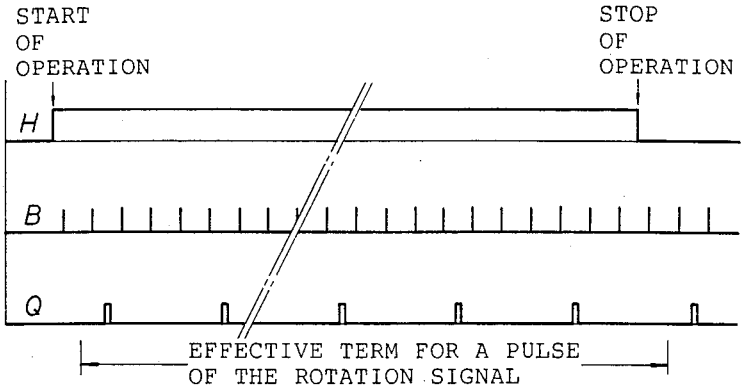
FIG. 17 is a timing chart.

As illustrated in FIG. 17, when the loom is started, the operation signal H becomes H-level and the contactless switch 73 generates a pulse tain of the rotation signal B as the crankshaft 14 rotates. At this stage, the AND gate 75 remains closed. Upon the arrival of the pin 76 at a position opposite the contactless switch 77, the contactless switch 77 provides a timing pulse Q, and thereby the AND gate 79 is opened and the flip-flop circuit 81 is set; consequently, the AND gate 75 is opened by the output signal of the flip-flop circuit 81. Then, the rotation signal B is given normally to the counter 131. That is, the AND gate 75 is opened by the first timing pulse Q after the loom has been started, and thereby the above-mentioned necessary control operation is executed.

In stopping the loom, the loom runs inertia after the operation signal H becomes L-level when the operation stop command is given. Therefore, the pulse train of the rotation signal B is generated for a while after the operation signal H has become L-level. However, since the flip-flop circuit 81 is reset through the AND gate 80 by the first timing pulse Q provided by the contactless switch 77 after the operation signal H has become L-level to close the AND gate 75, the counter 131 is unable to read the rotation signal B after the operation signal H has become L-level.

Thus, the timing of the start of reading the rotation signal B at the start of the loom and the timing of stop of reading the same at the stop of the loom are regulated correctly by the timing pulse Q. Accordingly, there is no possibility of erroneous reading of the number of rotation of the crankshaft of the loom even if there is a time difference between the generation and cancellation of the operation signal H and the generation and termination of the pulse train of the rotation signal B.

Since the position of the pin 76 on the gear 72 is determined selectively so that the pulse train of the rotation signal B and the timing pulse Q will not overlap each other in time, any pulse of the rotation signal B will not be lost when the AND gate 75 is opened and closed by the timing pulse Q. Thus, the error in reading the number of rotaion of the crankshaft of the loom due to time difference between the operation signal H and the rotation signal B is eliminated by the timing circuit 78.

Figure 18:
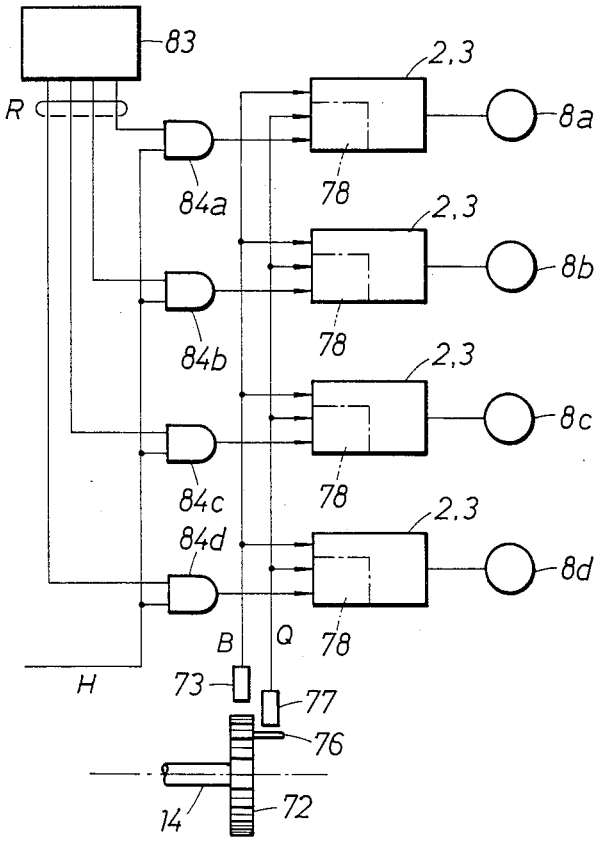
FIG. 18 is a block diagram showing the constitution of the present invention as applied to a multiple color picking system.

As illustrated in FIG. 18, the timing circuit 78 can be applied also to a multiple color picking system equipped with a plurality of feed motors 8*a*, 8*b*, . . . , and 8*d*. In a multiple color picking system, the command control unit 2, the drive control unit 3 and the timing circuit 78 are provided for each one of the feed motors 8a, 8b, . . . , and 8d. Weft yarn request signals R requesting the colored weft yarns 4, respectively, provided by a multiple color picking control unit 83, and the operation signal H are applied to the respective inputs of AND gates 84a, 84b, . . . , 84d. The flip-flop circuit 81 of each timing circuit 78 is controlled by the output of the corresponding one of the AND gates 84a, 84b, . . . , and 84d, namely, the logical product of the weft yarn request signal R and the operation signal H. The output signal of the contactless switch 73, namely, the rotation signal B , and the output signal of the contactless switch 77, namely, the timing pulse Q, are given to the command control unit 2 and the timing circuit 78.

When the timing circuit is thus incorporated into such a multiple color picking system, the start and stop of reading the rotation signal B is regulated accurately both by the weft yarn request signal R and the timing pulse Q. Accordingly, a plurality of the feed motors 8a, 8b, . . . , and 8d are controlled in the same manner as a single feed motor 8.

The combinations of the gear 72 and the contactless switch 73, and the pin 76 and the contactless switch 77 may be substituted by any other suitable pulse generators; the flip-flop circuit 81 may be any other optional memory device; the functions of the timing circuit 78 may be substituted by softwares for a microcomputer.

As apparent from the foregoing description, since the fifth embodiment is capable of eliminating the influence of time differnce between the operation signal H and the pulse train of the rotation signal B on the correction control of the feed motor speed control system by the pulse generator which generates a timing pulse Q at a fixed crankshaft angle of the loom, and a timing circuit 78 which regulates an effective period for reading the rotation signal B in synchronism with the timing pulse Q, there is no possibility of disagreement between the actual number of rotation of the crankshaft of the loom and the detected number of rotation of the same represented by the rotation signal B. Therefore, there is no possibility of winding an excessive or insufficient length of the weft yarn on the measuring and storing drum at the start and stop of the loom.

Furthermore, when incorporated into a multiple color picking system, the fifth embodiment is capable of selectively controlling the feed motors 8a, 8b, . . . , and 8d in response to the respective weft yarn request signals so that an appropriate length of the corresponding weft yarn is wound on the corresponding measuring and storing drum.

Although the invention has been described in its preferred forms with a certain degree of particularity, it is to be understood that the present invention is not limited in application to those foregoing embodiment and many variations and changes are possible in the invention without dearting from the scope and spirit thereof.

What is claimed is:

1. A weft yarn feeding device (1) for measuring and winding a weft yarn (4) around the circumference of a stationary measuring and storing drum (7) by the rotary motion of a rotary yarn guide (6) and storing the weft yarn (4) on the measuring and storing drum (7) for picking, which comprises:

(a) a feed motor (8) for rotating the rotary yarn guide (6);

(b) a drive control unit (3) for driving the feed motor (8); and (c) a command control unit (2) which provides command signals for controlling the feed motor (8), said command control unit (2) comprising a rotation detector (15) for detecting the number of rotations of the crankshaft (14) of the loom, a rotation detector (12) for detecting the number of rotations of the output shaft of the feed motor (8), an arithmetic and storage device (13) which adds rotation signals given thereto by the rotation detector (15) and subtracts rotations signals given thereto by the rotation detector (12), and a command signal generator (18) which converts the output signal of the arithmetic and storage device (13) into a command signal and gives the command signal to said drive control unit (3).

2. A weft yarn feeding device (1) according to claim 1, wherein said command control unit (2) includes a signal converter (16) which converts the output signal of said rotation detector (15) into a pulse train, and the signal converter (16) is a divider or a frequency divider which divides the rotation signal provided by the rotation detector (15) according to the length of the weft yarn (4) to be wound on the measuring and storing drum (7) for one picking cycle, and gives the divided rotation signal to the arithmetic and storage device (13).

3. A weft yarn feeding device (1) according to claim 1, wherein said arithmetic and storage device (13) has an up-down counter (131) which receives the rotation signal from said rotation detector (15) at the up-input thereof, and receives the rotation signal from the rotation detector (12) at the down-input thereof.

4. A weft yarn feeding device (1) according to claim 1, wherein said drive control unit (3) has a drive controller (21) which drives the feed motor (8) at least through proportional action on the basis of a command signal given thereto by said command control unit (2).

5. A weft yarn feeding device (1) according to claim 4, wherein said drive control unit (3) has a reference setting device (23) which applies a voltage corresponding to the reference number of rotation of the rotary yarn guide (6) to the input of said drive controller (21).

6. A weft yarn feeding device (1) according to claim 4, wherein said drive control unit (3) has a F/V converter (22) which converts the output signal of the rotation detector (12) into a voltage, and feeds back the voltage corresponding to the output signal of the rotation detector (12) to the input of the drive controller (21).

7. A weft yarn feeding device (1) according to claim 4, wherein said drive control unit (3) has a changeover switch (25) which connects the input of the drive controller (21) to a point (32) of zero in potential when the loom is stopped.

8. A weft yarn feeding device (1) according to claim 4, wherein said drive control unit (3) has a pareparatory winding controller (26) which rotates the output shaft of the feed motor (8) by a fixed number of turns while the loom is stopped.

9. A weft yarn feeding device (1) according to claim 1, wherein said command signal generator has a DA converter (181) which converts the digital output signal of the arithemetic and storage device (13) into an analog command siagnal, and gives the analog command signal to said drive control unit (3).

10. A weft yarn feeding device (1) according to claim 1, wherein said drive control unit (3) includes a changeover control unit (33) which interrupts the output rotation signal of the rotation detector (15) in synchronism with weft yarn selection signals, feeds the output command signal of said command control unit (2) to the drive control unit (3) continuously while an operation signal indicating the operation of the loom is provided, feeds the reference signal provided by the reference setting device (23) continuously to the drive control unit (3) while the operation signal is being given in the regular interval picking mode, and feeds the reference signal intermittently to the drive control unit 3 in synchronism with weft yarn selection signals in the free interval picking mode.

11. A weft yarn feeding device (1) according to claim 10, wherein said changeover control unit (33) has a driving circuit (36) for controlling the output contact of the reference setting device (23), and the driving circuit (36) is connectd to the outut of an AND gate (38) which receives the operation signal at one of the input thereof and receives selectively through a changeover means (39) either the weft yarn selection signal or the operation signal at the other input thereof.

12. A weft yarn feeding device (1) according to claim 11, wherein said changeover means (39) comprises a read means (46) which reads previously a weft yarn selection pattern provided by a weft yarn selecting device (42), and a changeover switch (40) automatically controlled by the output signal of the read means (46).

13. A weft yarn feeding device (1) according to claim 8, wherein said preparatory winding controller (26) comprises a preparatory winding control unit (50) which provides a preparatory winding rotation signal upon the reception of a preparatory winding command signal and interrupts the preparatory winding rotation signal when a predetermined number of loops of the weft yarn is wound on the measuring and storing drum (7), and a preparatory winding monitoring timer (51) which receives the preparatory winding rotation signal, interrupts the feed of the preparatory winding rotaion signal to the drive controller (21) and provides an alarm signal indicating abnormal preparatory winding operation, when the duration of the preparatory winding rotation signal exceeds a predetermined time.

14. A weft yarn feeding device (1) according to claim 2, wherein said signal converter (16) comprises a ROM (69) which converts the rotation signal (B) provided by the rotation detector (15) into a plurality of pulse signals of different pulse patterns appropriate for controlling the length of the weft yarn, respectively, a signal selection circuit (70) which selects one of a plurality of the pulse signals, and a setting circuit (71) for setting a mode of selecting the pulse signals.

15. A weft yarn feeding device (1) according to claim 1, wherein said command control unit (2) comprises pulse generators (77) which generates timing pulses at a fixed crankshaft angle of the loom, and a timing circuit (78) which regulates an effective period for reading the rotation signal to detect the number of rotation of the crankshaft of the loom.

16. A weft yarn feeding device (1) according to claim 15, wherein said timing pulse does not overlap the pulse train of the rotation signal in time.

17. A weft yarn feeding device (1) according to claim 15, wherein said timing circuit (78) includes a memory device (81) which is controlled by the operation signal indicating the operation of the loom.

18. A weft yarn feeding device (1) according to claim 15, wherein said timing circuit (78) includes a memory device (81) which is controlled by the logical product of the rotation signal and a weft yarn request signal provided by a multiple color picking control unit (83).

* * * * *